US011732540B2

(12) United States Patent
Cotton et al.

(10) Patent No.: US 11,732,540 B2
(45) Date of Patent: Aug. 22, 2023

(54) ISOLATION TOOL

(71) Applicant: Patriot Research Center, LLC, Houston, TX (US)

(72) Inventors: Craig Cotton, Cypress, TX (US); Brandon Cain, Houston, TX (US)

(73) Assignee: Patriot Research Center, LLC, Houston, TX (US)

( * ) Notice: Subject to any disclaimer, the term of this patent is extended or adjusted under 35 U.S.C. 154(b) by 0 days.

(21) Appl. No.: 17/643,140

(22) Filed: Dec. 7, 2021

(65) Prior Publication Data

US 2023/0175337 A1 Jun. 8, 2023

(51) Int. Cl.
*E21B 33/03* (2006.01)

(52) U.S. Cl.
CPC ..... *E21B 33/03* (2013.01)

(58) Field of Classification Search
CPC ..... E21B 33/03
USPC ..... 166/75.13
See application file for complete search history.

(56) References Cited

U.S. PATENT DOCUMENTS

| | | | | |
|---|---|---|---|---|
| 8,899,315 | B2 * | 12/2014 | Nguyen | E21B 33/03 166/85.1 |
| 2015/0000982 | A1 * | 1/2015 | McDowell | E21B 34/10 175/57 |
| 2019/0106961 | A1 * | 4/2019 | Hardesty | E21B 33/128 |
| 2019/0203559 | A1 * | 7/2019 | Ezell | E21B 23/10 |
| 2021/0189851 | A1 * | 6/2021 | Ellithorp | E21B 43/38 |

* cited by examiner

*Primary Examiner* — Matthew R Buck
*Assistant Examiner* — Patrick F Lambe
(74) *Attorney, Agent, or Firm* — Ramey LLP

(57) ABSTRACT

An isolation tool is provided that includes an upper elastomer, a lower elastomer. The isolation tool when set provides a circumferential flow path between the elastomers. The isolation tool also includes a longitudinal flow path from above the isolation tool to below the isolation tool. The longitudinal flowpath is preferably sufficiently linear that a solid tool may be passed through the longitudinal flowpath from above the isolation tool to below the isolation tool.

14 Claims, 6 Drawing Sheets

ISOLATION TOOL

BACKGROUND

Once an oil and gas well is drilled, casing is inserted into the wellbore and cemented in place. A wellhead may then be attached via compression fittings, welding, bolts, etc. to the upper end of the casing. The wellhead generally includes a throughbore that is coaxial with the wellbore and may also include side ports. In many instances the side ports will have valves attached so that the side port may be opened or closed as needed. In some instances, the side ports are required to be closed in order to remove the side port valve. In many instances a plug may be inserted into the port, bolted in place, and the valve removed. Unfortunately, once the wellhead is installed on a well, in many instances, it is impractical to plug the valve side ports as the interior of the wellhead may be pressurized.

SUMMARY

The present invention allows an operator to block fluid access through the side ports from the interior of the wellhead without needing to access the exterior of the side port through the side port valves. The operator may place the isolation tool within the wellhead. The isolation tool may include a mandrel having an upper seal, a lower seal, and a throughbore. Generally, the upper seal and the lower seal are spaced a sufficient distance apart to allow the mandrel, the upper seal, and the lower seal to bridge a side port within the wellhead. The isolation tool is lowered within the wellhead until the lower seal is below the side port and the upper seal is above the side port. Preferably, the isolation tool will include a lower facing shoulder that will land on and be supported by an upper facing shoulder within the wellhead. As the isolation tool is lowered into the wellhead the upper seal will engage with the interior wall of the wellhead above the side port and the outer surface of the mandrel. Once the isolation tool is in position the lower end of the isolation tool is drawn upwards. As the lower end of the isolation tool is drawn upwards the lower seal is engaged by a circumferential wedge that forces the lower seal into sealing engagement with the interior wall of the wellhead below the side port as well as the exterior surface of the mandrel. The lower end of the isolation tool is then held in position by a serrated wedge, threads, or simply friction.

Typically, a mechanical setting tool is run into the wellhead along with the isolation tool. The mechanical setting tool may include a drive assembly where the drive assembly rotates a threaded rod within the isolation tool. The threaded rod engages a cooperating thread set such as a nut. The threaded rod may have a portion locked into position such as a connection to an interior portion of the upper end of the isolation tool. As the threaded rod is rotated the cooperating thread set is moved towards the upper end of the isolation tool. The cooperating thread set is engaged with the lower end of the isolation tool and the circumferential wedge such that as the cooperating thread moves towards the upper end of the isolation tool the circumferential wedge is also drawn upwards thereby forcing a circumferential seal into contact with the inner wall of the wellhead and the exterior surface of the mandrel. Once the lower end of the isolation tool is in sealing engagement with the inner wall of the wellhead the mechanical setting tool is removed from an interior bore of the isolation tool. A slip system to prevent the movement of the isolation tool within the wellbore due to differential pressure in the wellbore above the isolation tool and below the isolation tool is not utilized as the isolation tool provides a fluid flowpath through the isolation tool preventing a pressure differential.

In another embodiment hydraulic pressure within the wellhead may be utilized to move the circumferential seal into sealing contact with the inner wall of the wellhead. A hydraulic setting tool may utilize pressure from the surface to move the piston within the isolation tool such that as the pressure from the surface is increased one end of the hydraulic setting tool is drawn towards the other end of the hydraulic setting tool to create a force such that the circumferential wedge is drawn upwards forcing a circumferential seal into contact between the inner wall of the wellhead and the exterior surface of the mandrel. Once the lower end of the isolation tool is in sealing engagement between the inner wall of the wellhead and the exterior surface of the mandrel the hydraulic setting tool is removed from the interior bore of the isolation tool. In certain instances, as the pressure from the surface is increased an end of the hydraulic setting tool may be pushed towards the other end of the hydraulic setting tool creating the force to drive the circumferential wedge upwards.

In an alternative embodiment of the isolation tool, the isolation tool is lowered into the tubular until it reaches the desired position bridging a side port. The isolation tool is held in position while the mechanical setting tool is engaged causing a drive assembly to rotate a threaded rod within the isolation tool. The upper end of the threaded rod is fixed in relation to an upper wedge assembly. The threaded rod engages a cooperating thread set. The cooperating thread set is fixed in relation to a lower wedge assembly. As the threaded rod is rotated the cooperating thread set is moved towards the upper end of the isolation tool. As the cooperating thread set moves towards the upper end of the isolation tool a force is created such that the upper wedge assembly moves downward while the lower wedge assembly moves upward. As the upper wedge assembly moves downward the upper wedge assembly forces the upper seal into sealing engagement with the interior wall of the tubular and an exterior surface of the mandrel. As the lower wedge assembly moves upwards the lower wedge assembly forces the lower seal into sealing engagement between the interior wall of the tubular and the outer surface of the isolation tool mandrel.

DETAILED DESCRIPTION

The description that follows includes exemplary apparatus, methods, techniques, or instruction sequences that embody techniques of the inventive subject matter. However, it is understood that the described embodiments may be practiced without these specific details. When referring to the top of the device or component top is towards the surface of the well. Side is radially offset from a component but minimally longitudinally offset.

Figure 1:
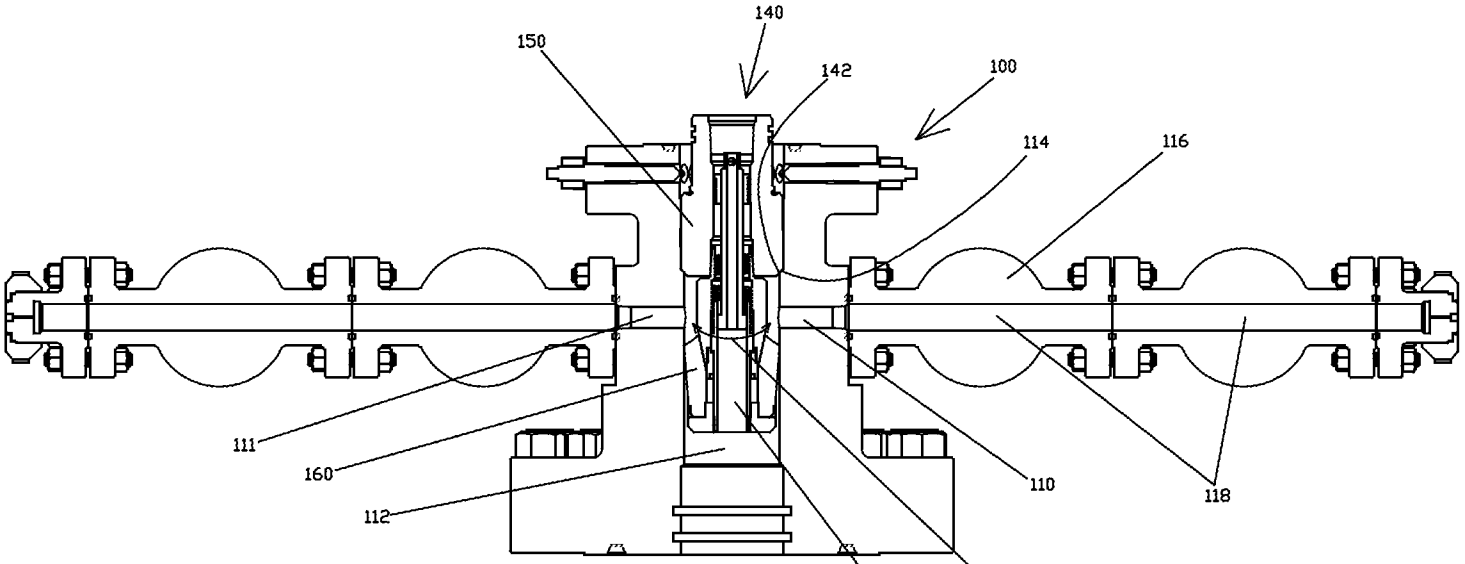
FIG. 1 is a side cutaway view of a wellhead having a side port, a throughbore, and a shoulder.

FIG. 1 is a side cutaway view of a wellhead 100 having a side port 110, a throughbore 112, and a shoulder 114. The wellhead 100 has a horizontal valve 116 attached to the wellhead 100 so that the throughbore 118 of the horizontal valve 116 is aligned with side port 110. When horizontal valve 116 is closed fluid access to the exterior of wellhead 100 through side port 110 is prevented. In certain instances an operator may desire to prevent fluid access to the exterior of wellhead 100 through side port 110 while at the same time disconnecting valve 116 from wellhead 100. In such an instance an isolation tool 140 is lowered into throughbore 112 of wellhead 100. The isolation tool 140 includes isolation tool shoulder 142. As the isolation tool 140 is lowered into the throughbore 112 of wellhead 100 the isolation tool shoulder 142 lands on shoulder 114 of wellhead 100. The isolation tool 140 includes an upper seal 150 and a lower seal 160 where upper seal 150 is above side port 110 while lower seal 160 is below side port 110. With the isolation tool in place two fluid pathways are created. The $1^{st}$ fluid pathway is a circumferential fluid pathway 154 between a side port 110 and a $2^{nd}$ side port 111. A $2^{nd}$ fluid pathway is a longitudinal fluid pathway through the isolation tool throughbore 152.

Figure 2:
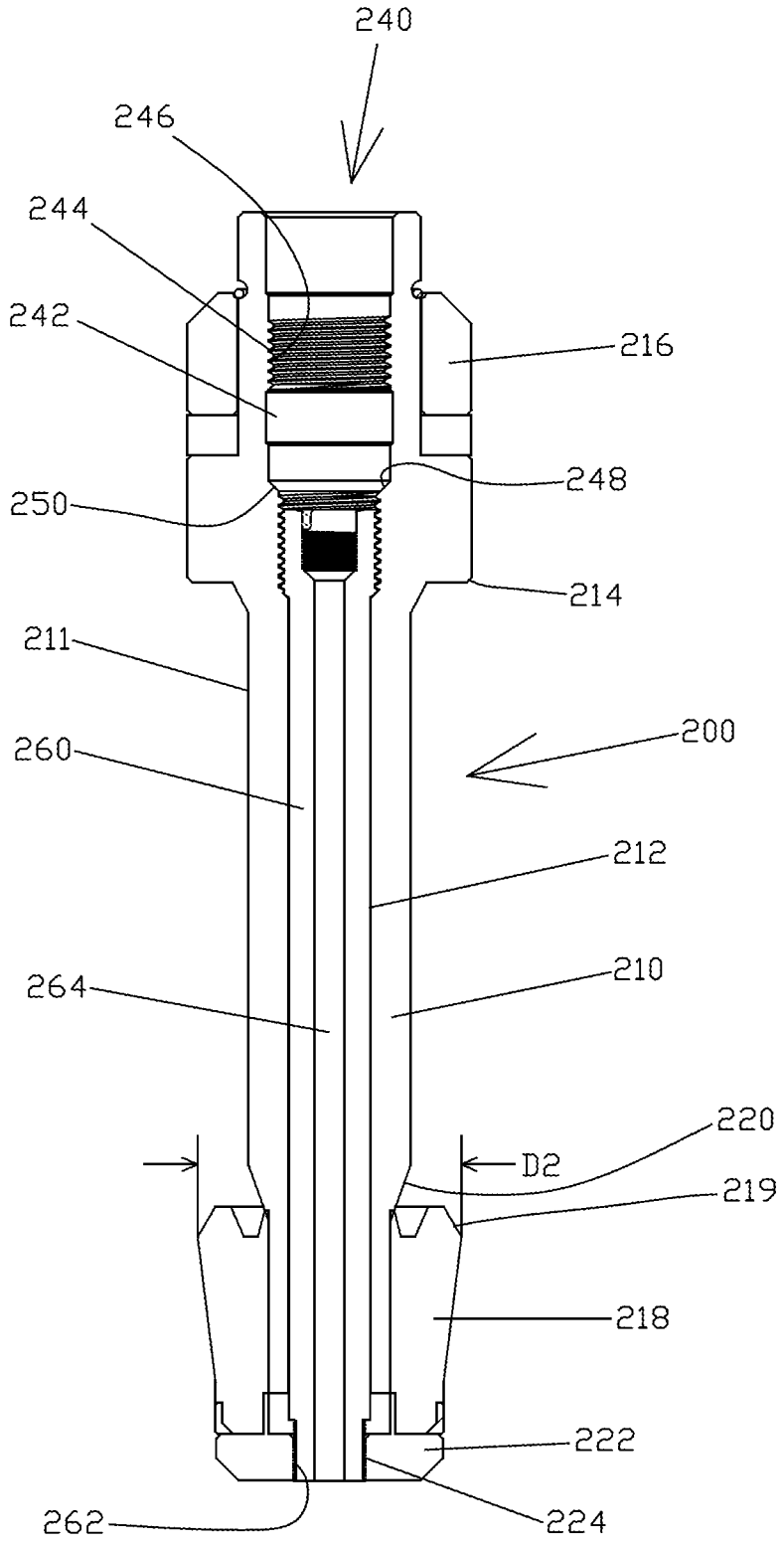
FIG. 2 is a side cutaway view of an isolation tool.

FIG. 2 is a side cutaway view of an isolation tool 200. Isolation tool 200 includes a mandrel 210, a throughbore 212, an upper shoulder 214, an upper elastomer 216, a lower elastomer 218, a lower circumferential wedge 220, and a lower plate 222, where the lower plate 222 has a $1^{st}$ cooperating thread 224. In many instances, mandrel 210 has an area of reduced diameter 211 between the upper elastomer 216 and the lower elastomer 218.

Within the mandrel throughbore 212 is the setting tool 240. The setting tool includes an upper plate 242. The upper plate 242 generally has an external cooperating thread set 244 where the external cooperating thread set 244 interacts with an upper thread set 246 located at the upper end of throughbore 212. Generally the upper plate 242 is threaded into the throughbore 212 by utilizing the external cooperating thread set 244 and upper thread set 246 until the upper plate shoulder 248 reaches upper shoulder 250 within throughbore 212. The setting tool also includes rod 260. Rod 260 has throughbore 264. Generally rod 260 is coaxial with upper plate 242 as well as lower plate 222. At the lower end of rod 260 is an external thread set 262.

In operation the isolation tool 200 may be run into the wellhead or other tubular until shoulder 214 is supported on a cooperating shoulder within the wellhead or other tubular. In other instances, the isolation tool 200 may be run into the wellhead or other tubular until the lower elastomer 218 is below the area to be isolated and the upper elastomer 216 is above the area to be isolated. With the isolation tool 200 in position rod 260 is rotated such that external thread set 262 cooperates with internal thread set 224 to move lower plate 222 towards upper plate 242. As lower plate 222 moves upwards the lower plate 222 contacts the lower end of elastomer 218 forcing elastomer 218 upwards.

Figure 3:
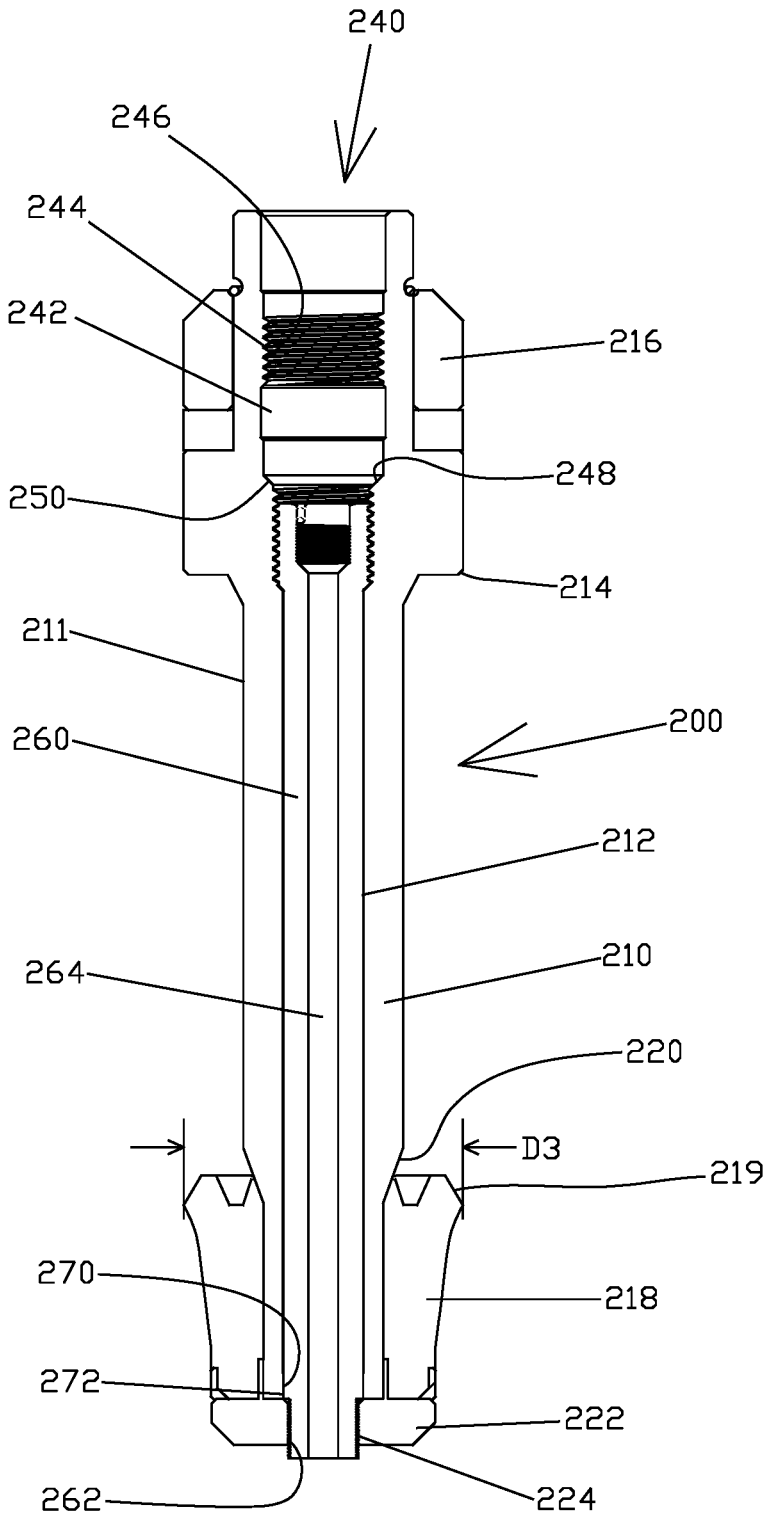
FIG. 3 is a side cutaway view of an isolation tool as the upper end of an elastomer is forced over a circumferential wedge.

As can be seen in FIG. 3 as the upper end 219 of elastomer 218 is forced over circumferential wedge 220 the outer diameter of elastomer 218 is increased from its initial diameter D2 to a $2^{nd}$ diameter D3. As shown in FIG. 3, the $2^{nd}$ diameter D3 of elastomer 218 is unconstrained. In practice, the isolation tool is lowered into a tubular where the inner diameter of the tubular is greater than diameter D2 but less than the unconstrained diameter D3. As the outer surface of elastomer 218 is forced against the inner wall of the tubular the elastomer forms a seal to prevent fluid and/or gas from passing between the outer surface of the mandrel 210 and the inner wall of the tubular (not shown). Generally, the lower plate 222 includes a locking mechanism to prevent the lower plate 222 from returning to its original position, and thus allowing the elastomer 218 to return to its original lower position thereby relaxing the elastomer 218 and allowing the outer diameter D3 to return to its original diameter D2 thereby releasing the seal between the mandrel 210 and the inner wall of the tubular. An outer diameter of a lower end of the mandrel 210 includes a ratchet 270 while the lower plate 222 includes a cooperating ratchet 272 such that as the lower plate 222 is moved towards upper plate 242 the ratchet mechanism locks the lower plate 222 in the upper position with respect to the mandrel 210. While a ratchet lock 270/272 is depicted other types of locking mechanisms may be utilized including a friction lock, where the lower plate 222 is forced onto the mandrel 210 tightly enough that the lower plate 222 will not return to its original position even when the force supplied by the cooperating thread sets 262 and 224 is removed. As shown rod 260 includes throughbore 264. Throughbore 264 allows fluids or devices to be passed through the isolation tool 200 from the top of the well towards the bottom of the well without removing the setting tool including rod 260, in which case the locking mechanism provided between the lower plate 222 in the mandrel 210 is not required. In other instances, rod 260 may be removed from the interior bore the isolation tool 200 by reverse threading out.

Figure 4:
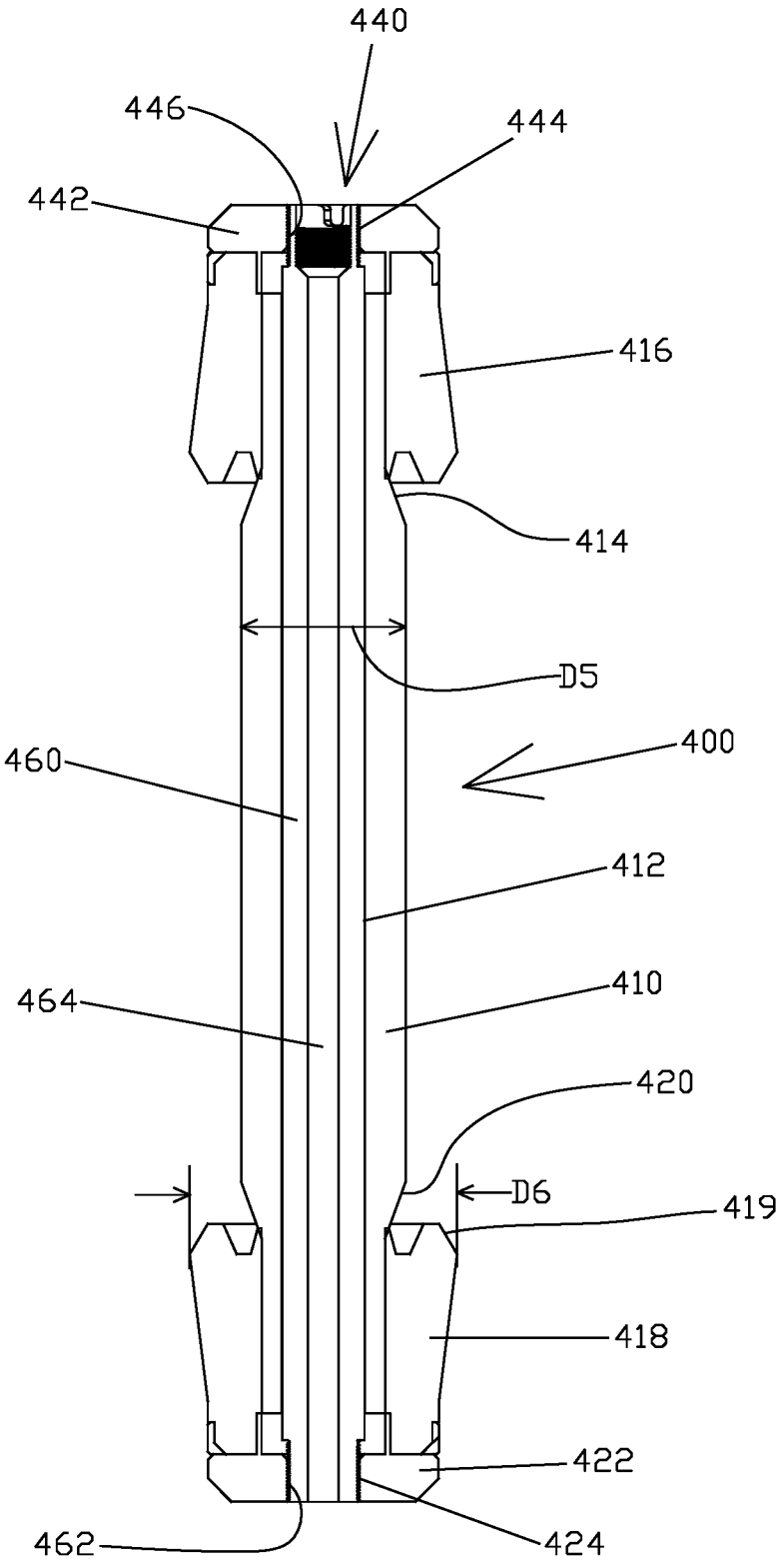
FIG. 4 is a side cutaway view of an alternative embodiment of an isolation tool.

FIG. 4 is an alternative embodiment of the isolation tool 400. Isolation tool 400 includes a mandrel 410, a throughbore 412, an upper elastomer 416, a lower elastomer 418, a lower circumferential wedge 420, an upper circumferential wedge 414, and a lower plate 422, where the lower plate 422 has a $1^{st}$ cooperating thread 424. Mandrel 410 has a diameter D5 between the upper elastomer 416 and the lower elastomer 418. The upper elastomer 416 and the lower elastomer 418 each have a diameter generally diameter D6. The mandrel diameter D5 is generally equal to or less than the upper elastomer 416 and lower elastomer 418 diameter D6.

Within the mandrel throughbore 412 is the setting tool 440. The setting tool includes an upper plate 442. The upper plate 442 generally has an external cooperating thread set 444 where the external cooperating thread set 444 interacts with an upper thread set 446 located at the upper end of throughbore 412. The setting tool includes rod 460. Rod 460 has throughbore 464. Generally, rod 460 is coaxial with upper plate 442 as well as lower plate 422. At the lower end of rod 460 is an external thread set 462.

In operation the isolation tool 400 may be run into the wellhead or other tubular until the lower elastomer 418 is below the area to be isolated and the upper elastomer 416 is above the area to be isolated. With the isolation tool 400 in position rod 460 is rotated such that external thread sets 462 and 446 cooperate with their respective internal thread sets 424 and 444 to move lower plate 422 towards upper plate 442. As lower plate 422 moves upwards, the lower plate 422 contacts the lower end of elastomer 418 forcing elastomer 418 upwards while at the same time upper plate 442 moves downwards, the upper plate 442 contacts the upper end of elastomer 416 forcing elastomer 416 downwards.

Figure 5:
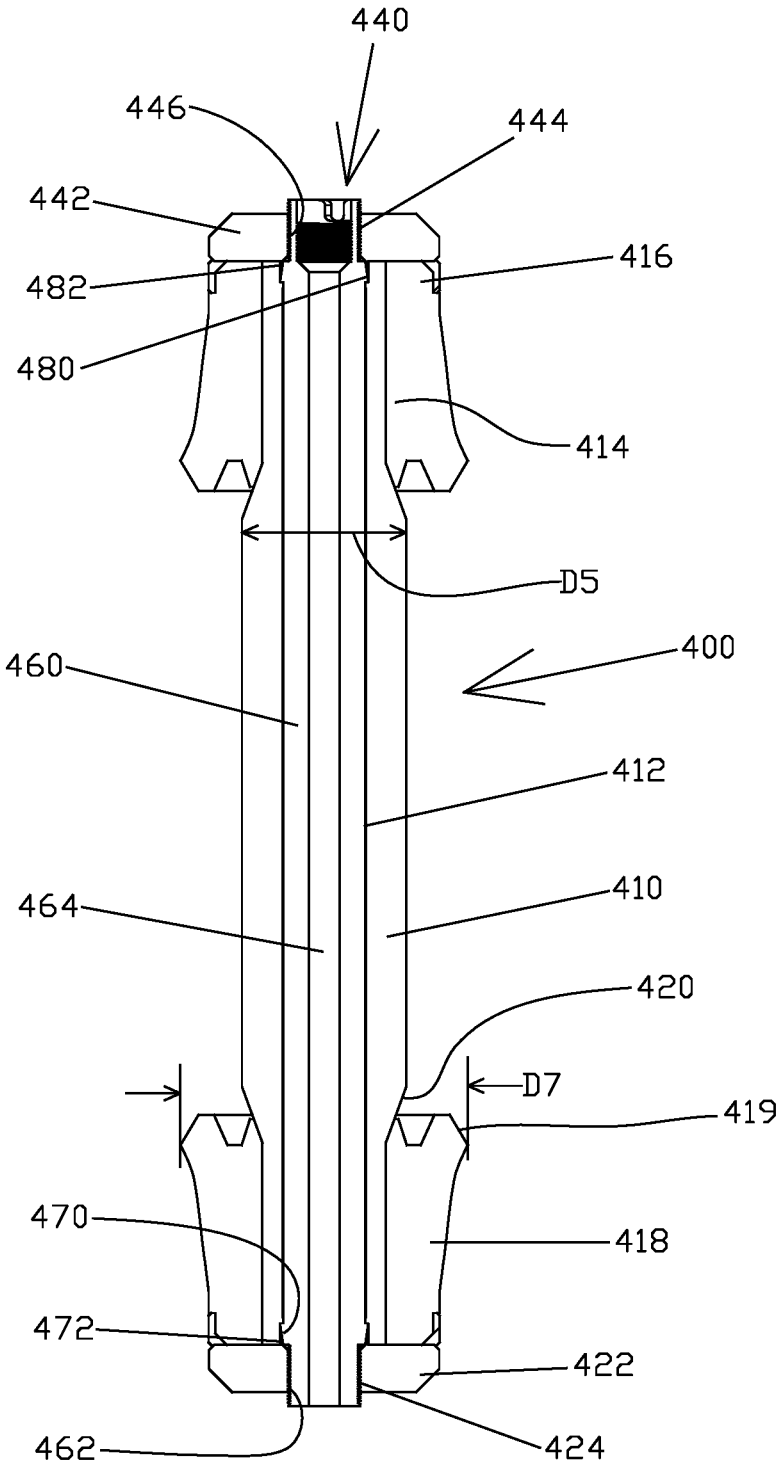
FIG. 5 is a side cutaway view of an alternative embodiment of an isolation tool as the upper end of an elastomer is forced over a circumferential wedge.

As can be seen in FIG. 5 as the upper end 419 of elastomer 418 is forced over circumferential wedge 420 the outer diameter of elastomer 418 is increased from its initial diameter D6 to a $2^{nd}$ diameter D7. At the same time the lower end 421 of elastomer 416 is forced over circumferential wedge 414 increasing the outer diameter of elastomer 416 from its initial diameter of about D6 to roughly a $2^{nd}$ diameter D7. As shown in FIG. 5 the $2^{nd}$ diameters D7 of elastomers 422 and 416 are unconstrained. In practice, the isolation tool 400 is lowered into a tubular where the inner diameter of the tubular is greater than diameter D6 but less than the unconstrained diameter D7. As the outer surface of elastomers 422 and 416 are forced against the inner wall of the tubular the elastomers 422 and 416 form a seal to prevent fluid and/or gas from passing between the outer surface of the mandrel 410 and the inner wall of the tubular (not shown).

Generally, the lower plate 422 and the upper plate 442 include a locking mechanism to prevent the lower plate 422 and the upper plate 416 from returning to their original position, thus allowing the elastomers 418 and 416 to return to their original position thereby relaxing the elastomers 418 and 416 allowing the outer diameter D7 to return to its original diameter D6 releasing the seal between the mandrel 410 and the inner wall of the tubular. An outer diameter of a lower end of the mandrel 410 includes a friction lock 470 while the lower plate 422 includes a cooperating friction lock 472 such that as the lower plate 422 is moved towards upper plate 442 the friction lock retains the lower plate 422 in the upper position with respect to the mandrel 410. Likewise, an outer diameter of an upper end of the mandrel 410 also includes a friction lock 480 while the upper plate 442 includes a cooperating friction lock 482 such that as the upper plate 442 is moved towards lower plate 422 the friction lock retains the upper plate 442 in the upper position with respect to the mandrel 410.

While a friction lock 470/472 is depicted, other types of locking mechanisms may be utilized including a ratchet lock. As shown rod 460 includes throughbore 464. Throughbore 464 allows fluids or devices to be passed through the isolation tool 400 from the top of the well towards the bottom of the well without removing the setting tool 440 or rod 460. In the event that the setting tool is not removed the locking mechanism provided between the lower plate 422, the upper plate 442, and the mandrel 410 is not required.

Figure 6:
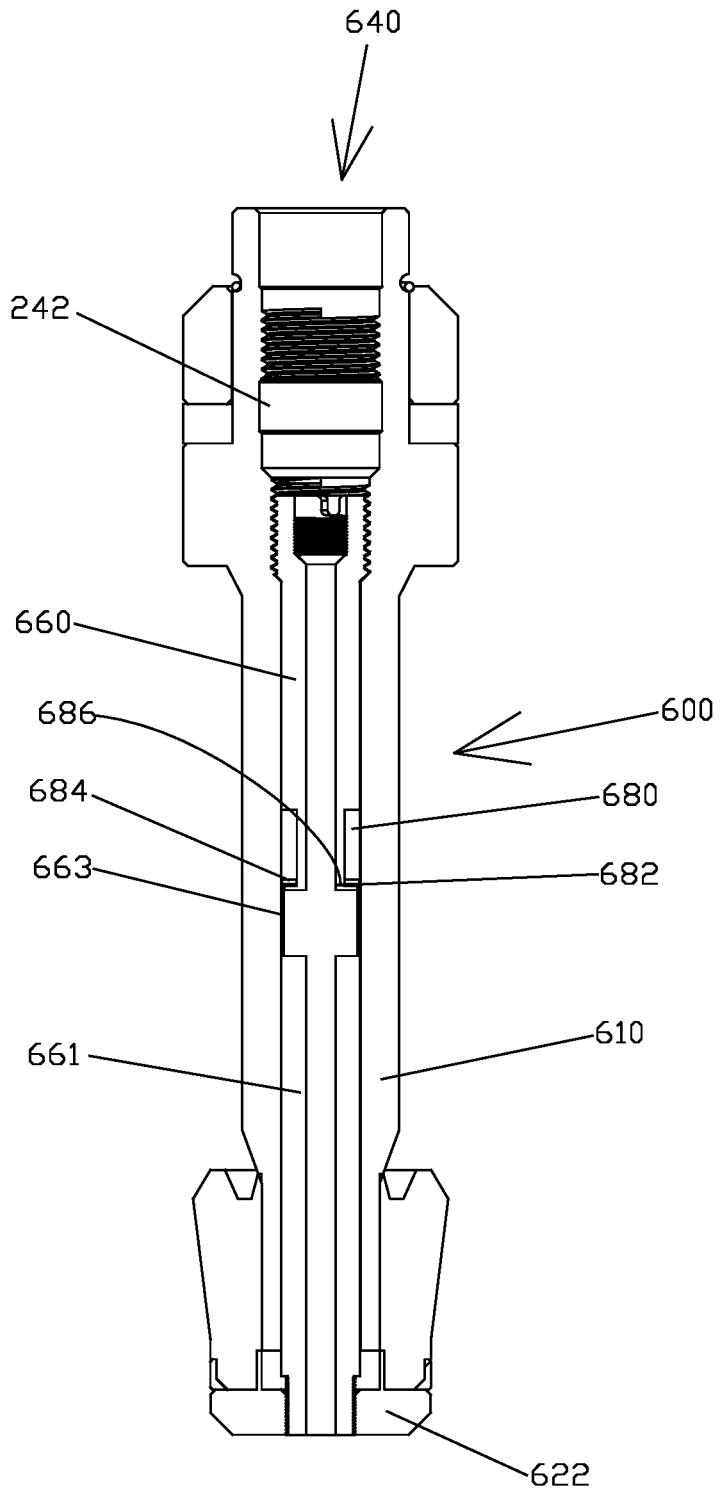
FIG. 6 is a side cutaway view of an alternative embodiment of an isolation tool including a hydraulic setting tool.

In other embodiments a hydraulic setting tool may be utilized. As depicted in FIG. 6, an isolation tool 600 includes a setting tool 640, a mandrel 610, an upper rod 660, a lower rod 661, and chamber 680. The lower rod 661 has an area reduced cross-section 663. A piston 684 is connected to the lower rod 661 via the area of reduced cross-section 663. In some instances, a separate rod may be utilized to connect piston 684 to lower rod 661. A hydraulic flowpath 686 is provided so that pressurized fluid may enter into the area 682 below piston 684 within chamber 680 to provide setting tool pressure to draw the upper plate 642 towards lower plate 622.

The nomenclature of leading, trailing, forward, rear, clockwise, counterclockwise, right hand, left hand, upwards, and downwards are meant only to help describe aspects of the tool that interact with other portions of the tool.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An isolation tool comprising;

a first elastomer, a second elastomer, a mandrel, and a circumferential wedge, wherein the mandrel includes a longitudinal fluid flowpath through the mandrel, further wherein the circumferential wedge radially expands the first elastomer or the second elastomer, and wherein, when the isolation tool is lowered into a wellbore, a lateral flowpath exists across the mandrel and between the first elastomer and the second elastomer.

2. The isolation tool of claim 1 wherein, the circumferential wedge moves from a circumferential wedge first position to a circumferential wedge second position moving the second elastomer from a second elastomer first position to a second elastomer second position.

3. The isolation tool of claim 1 wherein, the circumferential wedge is held in the circumferential wedge second position by a lock.

4. The isolation tool of claim 3 wherein, the lock is a friction lock.

5. The isolation tool of claim 1, further comprising a setting tool, wherein the setting tool moves the circumferential wedge from a circumferential wedge first position to a circumferential wedge second position.

6. The isolation tool of claim 5 wherein, the setting tool utilizes a rotational mechanical force to move the circumferential wedge from the circumferential wedge first position to the circumferential wedge second position.

7. The isolation tool of claim 5 wherein, the setting tool utilizes a hydraulic force to move the circumferential wedge from the first position to the second position.

8. An isolation tool comprising;

a first elastomer, a second elastomer, a mandrel, a first circumferential wedge, and a second circumferential wedge, wherein the mandrel includes a longitudinal fluid flowpath through the mandrel, further wherein the circumferential wedge radially expands the first elastomer and the second circumferential wedge radially expands the second elastomer, and wherein, when the isolation tool is lowered into a wellbore, a lateral flowpath exists across the mandrel and between the first elastomer and the second elastomer.

9. The isolation tool of claim 8 wherein, the first circumferential wedge moves from a first circumferential wedge first position to a first circumferential wedge second position moving the first elastomer from a first elastomer first position to a first elastomer second position, and the second circumferential wedge moves from a second circumferential wedge first position to a second circumferential wedge second position moving the second elastomer from a second elastomer first position to a second elastomer second position.

10. The isolation tool of claim 9 wherein, the second circumferential wedge is held in the first circumferential wedge second position by a lock.

11. The isolation tool of claim 10 wherein, the lock is a friction lock.

12. The isolation tool of claim 8, further comprising a setting tool, wherein the setting tool moves the second circumferential wedge from a second circumferential wedge first position to a second circumferential wedge second position.

13. The isolation tool of claim 12 wherein, the setting tool utilizes a rotational mechanical force to move the second circumferential wedge from the second circumferential wedge first position to the second circumferential wedge second position.

14. The isolation tool of claim 12 wherein, the setting tool utilizes a hydraulic force to move the second circumferential wedge from the second circumferential wedge first position to the second circumferential wedge second position.

* * * * *